US005152165A

United States Patent [19]

Shore et al.

[11] Patent Number: 5,152,165

[45] Date of Patent: Oct. 6, 1992

[54] ROLLING MILL

[75] Inventors: Terence M. Shore, Princeton; Harold E. Woodrow, Northboro, both of Mass.

[73] Assignee: Morgan Construction Company, Worcester, Mass.

[21] Appl. No.: 728,604

[22] Filed: Jul. 11, 1991

[51] Int. Cl.[5] ..... B21B 1/16; B21B 35/12

[52] U.S. Cl. ..... 72/235; 72/249

[58] Field of Search ..... 72/235, 249, 234, 238

[56] References Cited

U.S. PATENT DOCUMENTS

| | | | |
|---|---|---|---|
| 2,757,556 | 8/1956 | Uebing | 72/249 |
| 3,641,797 | 2/1972 | Bell et al. | 72/249 |
| 3,643,488 | 2/1972 | Bretchneider | 72/249 |
| 3,733,847 | 5/1973 | Spiecker | 72/235 |
| 4,024,746 | 5/1977 | Brück | 72/249 |
| 4,191,041 | 3/1980 | Brauer et al. | 72/235 |
| 4,385,530 | 5/1983 | Holthoff | 72/249 |
| 4,537,055 | 8/1985 | Woodrow et al. | 72/235 |
| 4,807,458 | 2/1989 | Buch et al. | 72/249 |

FOREIGN PATENT DOCUMENTS

| | | | |
|---|---|---|---|
| 145502 | 12/1980 | German Democratic Rep. | 72/249 |
| 186105 | 8/1986 | Japan | 72/249 |
| 130469 | 1/1960 | U.S.S.R. | |
| 1253688 | 8/1986 | U.S.S.R. | 72/249 |
| 1315057 | 6/1987 | U.S.S.R. | 72/249 |
| 975510 | 11/1964 | United Kingdom | 72/249 |

*Primary Examiner*—Lowell A. Larson
*Assistant Examiner*—Thomas C. Schoeffler
*Attorney, Agent, or Firm*—Samuels, Gauthier & Stevens

[57] ABSTRACT

A block type rolling mill has a plurality of roll stands arranged along a mill pass line, each roll stand having at least a first pair of work rolls mounted in cantilever fashion on a first pair of roll shafts. The first roll shafts have first pinion gears which are separate from each other and in meshed relationship respectively with one of a pair of intermeshed spur gears carried on a pair of intermediate drive shafts, with one of the intermediate drive shafts of each roll stand being coupled to one of two line shafts extending in parallel relationship to the mill pass line. At least one of the roll stands is provided with a second pair of work rolls mounted in cantilever fashion on a second pair of roll shafts. The second pair of roll shafts have second pinion gears which are separate from each other and each in meshed relationship respectively with one of the intermeshed spur gears of the at least one roll stand.

3 Claims, 2 Drawing Sheets

ROLLING MILL

BACKGROUND OF THE INVENTION

1. Field of the Invention

This invention relates generally to rolling mills, and is concerned in particular with an improvement in single strand block type finishing mills of the type employed in the twist-free rolling of rods, bars and other like products.

2. Description of the Prior Art

An example of a well-known single strand block type rolling mill is disclosed in U.S. Pat. No. 4,537,055, the disclosure of which is herein incorporated by reference in its entirety. In mills of this type, as herein further depicted schematically in FIGS. 1–3, successive roll stands $ST_1$–$ST_{10}$ are alternately arranged along opposite sides of the mill pass line P. The roll pairs $R_1$–$R_{10}$ of the successive roll stands are oppositely inclined and appropriately grooved to roll the product in an oval-round sequence and in a twist-free manner.

The output shaft 10 of a mill drive motor 12 drives the center gear 14 of a speed increaser 16. Gear 14 in turn drives a pair of side gears 18, 20 carried on line shafts 22,24 extending in parallel relationship to the mill pass line P. Segments of the line shafts extend through and are journalled for rotation in the roll stands, with their adjacent protruding ends being externally coupled to each other by couplings 26. Because of the staggered relationship of the roll stands, roll stand $ST_9$ is spaced from the speed increaser 16 by a gap which is bridged by a Cardan shaft segment 24*a*.

With reference in particular to FIGS. 2 and 3, it will be seen that each line shaft segment located within a roll stand carries a drive bevel gear 28 which meshes with a driven bevel gear 30 carried on one of two parallel intermediate drive shafts 32. The intermediate drive shafts carry intermeshed spur gears 34. The work rolls R are removably mounted in cantilever fashion on the ends of parallel roll shafts 36. Each roll shaft carries a pinion gear 38 which meshes with one of the spur gears 34. The spur and pinion gears 34, 38 are thus arranged in what is commonly referred to as a "four gear cluster".

Although not shown, it will be understood that adjustment means are internally provided at each roll stand for adjusting the parting between the work rolls. Such adjustment means typically shift the roll shafts 36 and their pinion gears 38 symmetrically in opposite directions in relation to the mill pass line, while allowing the intermediate drive shafts 32 and their intermeshed spur gears 34 to remain undisturbed. Guides (also not shown) are provided between the successive work roll pairs to guide the product along the mill pass line. Conventionally, the spacing "C" between successive work roll pairs (commonly referred to as the "stand center" distance) will be on the order of 600–800 mm.

In a typical modern high speed rod rolling operation, a 16–24 mm round will be delivered to stand $ST_1$ from an upstream intermediate mill (not shown) at a speed of about 8–18 m/sec, and will exit from the last stand $ST_{10}$ as a finished 5.5 mm round at a speed of around 100 m/sec. The ratios of the successive bevel gear sets 28,30 and four gear clusters 34,38 are selected to accommodate the rapidly accelerating product and to insure that the product is under a slight tension as it progresses through the mill.

Conventionally, the cross section of the product exiting from the finishing block will be within tolerances which are acceptable for some but not all purposes. For example, a properly rolled 5.5 mm round will have a tolerance at or slightly below the limit of ±0.15 mm as specified by ASTM-A29. Such products may be used "as is" for many applications, including for example welding mesh, chicken wire, etc. For other uses, however, such as for example valve steels, much tighter tolerances on the order of ¼ ASTM are required. Such products are commonly referred to as "precision rounds". In the past, this level of precision has been achieved either by subjecting the bars to a separate machining operation after the rolling operation has been completed, or by continuously rolling the bars through additional separately driven "sizing stands".

The separate machining operations, commonly referred to as "peeling", add significantly to the cost of the finished products. Although continued rolling through sizing stands is less costly, the relatively light reductions taken in each sizing pass at a location downstream from the finishing block appear to encourage unacceptable levels of grain growth, which in extreme cases require remedial action in the form of separate and costly heat treatments.

SUMMARY OF THE INVENTION

The basic objective of the present invention is to enable precision rounds to be rolled in the finishing block, thereby eliminating any need for subsequent separate machining operations or additional rolling in separately driven downstream sizing stands.

A further objective of the present invention is to roll precision rounds without encouraging unacceptable levels of grain growth.

Companion objectives include an overall improvement in the tolerances of products finished out of the last stand of the block, as well as the rolling of smaller diameter rounds in the finishing block.

These and other objectives and advantages are achieved by introducing at least one modified roll stand into the conventional mill finishing block. The modified roll stand includes the conventional intermediate drive shaft carrying intermeshed spur gears, with one of the intermediate drive shafts being mechanically coupled to a respective one of the line shafts by a bevel gear set. In contrast to conventional arrangements, however, the intermediate drive shafts are located between and mechanically coupled to two pairs of roll shafts. Each pair of roll shafts carries pinion gears meshing with the spur gears on the intermediate drive shafts, thereby establishing what may be termed as a "six gear cluster". The first or "upstream" roll shafts carry work rolls which are adapted to take a relatively light "sizing" reduction. These rolls are located in relatively close proximity to the work rolls of the preceding stand. The second or "downstream" roll shafts carry work rolls adapted to take a normal reduction on the order of 20%.

One or more modified roll stands may be employed at different locations along the finishing block to achieve various objectives. For example, any one of the conventional stands $ST_3$, $ST_5$ or $ST_9$ may be replaced by a single modified stand. With this arrangement, the upstream sizing rolls of the modified stand may be employed to "size" the round received from the previous stand, with the second or "downstream" roll pair of the modified stand as well as the roll pairs of all subsequent stands in the block being rendered inoperative, i.e., "dummied", thereby delivering a larger diameter precision round out of the block. With the same arrangement, all roll pairs may remain operative, in which event the sized round will continue to be rolled through the remainder of the block, the net result being a smaller diameter finished product with improved tolerances.

In another arrangement, the Cardan shaft segment 24a and the last roll stand $ST_{10}$ are replaced with two modified roll stands. By employing appropriate combinations of operative and dummied roll pairs in these modified roll stands, this arrangement makes it possible to either size the normal round being delivered out of the tenth modified stand, or to produce a smaller product, e,g., a 4.5 mm rod out of the eleventh modified stand.

A more detailed description of the invention will now be provided with reference to the accompanying drawings, wherein:

DETAILED DESCRIPTION OF ILLUSTRATED EMBODIMENT

Figure 4:
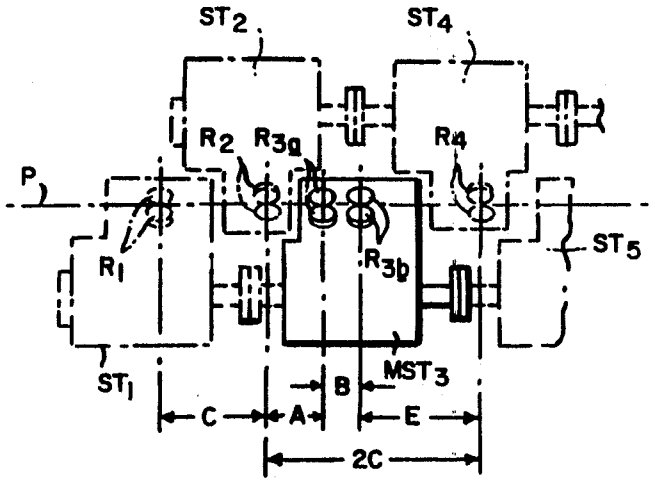
FIG. 4 is a schematic partial top plan view of a single block type rolling mill showing a modified roll stand $MST_3$ in accordance with the present invention substituted in place of the conventional third roll stand $ST_3$.
Figure 2:
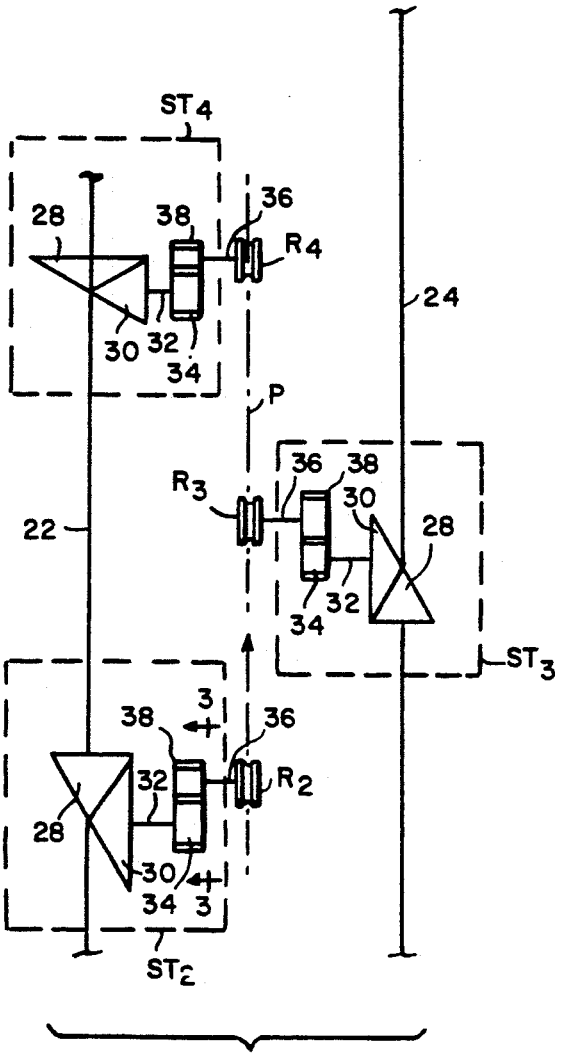
FIG. 2 PRIOR ART
FIG. 2 is an enlarged schematic illustration of the drive components of roll stands $ST_2$, $ST_3$ and $ST_4$ of the mill shown in FIG. 1.
Figure 5:
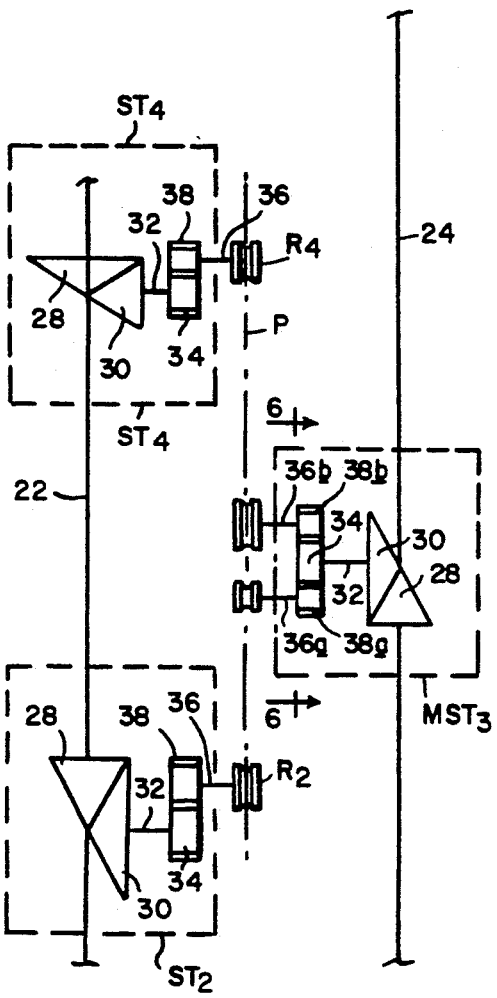
FIG. 5 is an enlarged schematic illustration of the drive components of the roll stands shown in FIG. 4.
Figure 3:
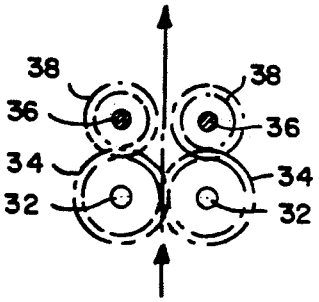
FIG. 3 PRIOR ART
FIG. 3 is a sectional view taken on line 3—3 of FIG. 2.
Figure 6:
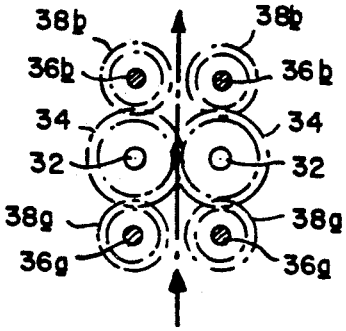
FIG. 6 is a sectional view taken along line 6—6 of FIG. 5.

Referring now to FIGS. 4–6, a modified roll stand $MST_3$ in accordance with the present invention is shown in place of the conventional roll stand $ST_3$. The modified stand includes the previously described set of bevel gears 28, 30 for establishing a drive connection between line shaft 24 and one of two parallel intermediate drive shafts 32. The intermediate drive shafts are again mechanically interconnected by intermeshed spur gears 34. First and second pairs of roll shafts 36a, 36b are arranged respectively on the upstream and downstream sides of the intermediate drive shafts 32. The roll shafts 36a, 36b are provided respectively with pinion gears 38a, 38b which mesh with respective ones of the spur gears 34 arranged therebetween. The resulting arrangement may therefore be described as a "six gear cluster". The roll shafts 36a, 36b respectively carry work rolls $R_{3a}$ and $R_{3b}$.

The work rolls $R_{3a}$ are adapted to size a round received from the preceding roll stand $ST_2$. The term "sizing" connotes the taking of a reduction on the order of 0.2 to 10% in one pass, which is relatively light in comparison to the normal average reduction on the order of 20% taken in the immediately preceding roll stand $ST_2$.

With reference to FIG. 4, It will be seen that as a result of the introduction of two roll pairs $R_{3a}$, $R_{3b}$ in place of the conventional single roll pair $R_3$, the stand spacing 2C between stands $ST_2$ and $ST_4$ will be reconfigured into a close spacing "A" between rolls $R_2$ and $R_{3a}$, and resulting arbitrary spacings "B" between rolls $R_{3a}$ and $R_{3b}$ and "E" between rolls $R_{3b}$ and $R_4$.

When rolling with normal average 20% reductions in an oval-round pass sequence, the round process sections exhibit a tendency to twist. Such twisting is resisted by the stabilizing effect of the downstream oval roll passes. However, in a sizing operation, where the pass sequence is round-round, there is no equivalent stabilizing effect. Thus, it is essential that the sizing pass be located as closely as possible to the preceding roll pas in order to effect sizing before twisting can take place. The present invention satisfies this criteria by providing a spacing "A" between the sizing rolls $R_{3a}$ and the preceding rolls $R_2$ on the order of 100–150 mm, which is substantially less than the normal stand spacing "C".

The thus sized round can be taken as the finished product of the mill, in which event the other pair of rolls $R_{3b}$ of the modified stand as well as the rolls $R_4$–$R_{10}$ of the remaining stands are dummied. Alternatively, the thus sized round may continue to be rolled through rolls $R_{3b}$ and one or more succeeding roll passes to produce a progressively smaller round which because of the intermediate sizing operation at rolls $R_{3a}$, will also be characterized by improved tolerances, although probably not to the extent required to qualify the product as a precision round.

Figure 1:
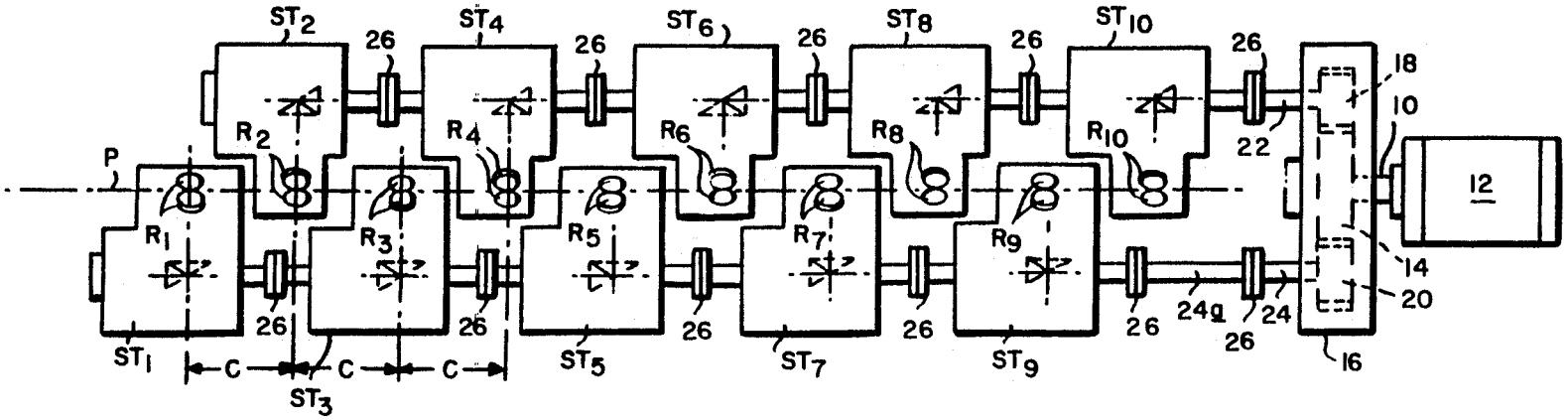
FIG. 1 PRIOR ART
FIG. 1 is a schematic top plan view of a conventional single strand block type rolling mill of the type described in U.S. Pat. No. 4,537,055.
Figure 7:
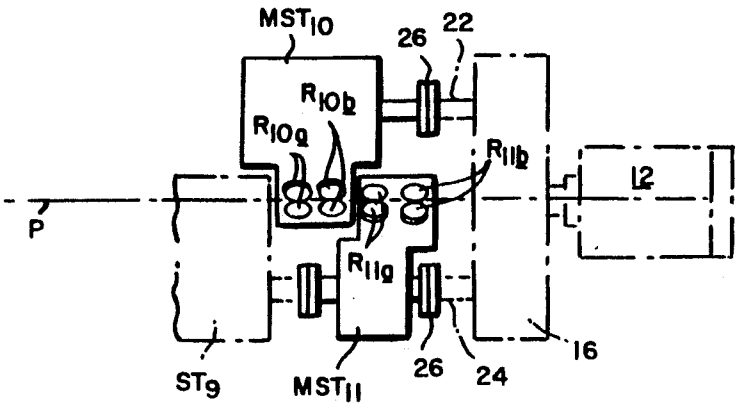
FIG. 7 is another schematic partial top plan view of a single strand block type rolling mill showing the last conventional roll stand $ST_{10}$ and the Cardan shaft segment 24a replaced by two modified roll stands $MST_{10}$ and $MST_{11}$ in accordance with the present invention.

Another embodiment of the invention is illustrated in FIG. 7. Here, the last stand $ST_{10}$ and the Cardan shaft segment 24a have been replaced by modified stands $MST_{10}$ and $MST_{11}$. Except for their modified external configurations and different gear ratios, the stands $MST_{10}$ and $MST_{11}$ are characterized by the same basic design as the previously described modified stand $MST_3$. This embodiment offers the following possibilities:

a) by dummying rolls $R_{11a}$, rolls $R_{10a}$, $R_{10b}$ and $R_{11b}$ can be employed to take normal average reductions on the order of 20% in a round-oval-round pass sequence to produce a smaller round, e.g., 4.5 mm in diameter;

b) by dummying rolls $R_{11b}$, taking a normal average reduction of 20% at rolls $R_{10a}$ to produce a 5.5 mm round, taking a slight reduction on the order of 2% at rolls $R_{10b}$ to produce a very slight ovality (commonly referred to as "leader round"), and using rolls $R_{11a}$ in the normal sizing mode, a 5.5 mm precision round can be obtained.

It thus will be seen that by employing one or more modified roll stands in a single strand block of otherwise conventional configuration, substantial advantage can be gained, with only a relatively modest expenditure as compared to that required to achieve comparable results with conventional equipment and/or processes.

We claim:

1. In a block type rolling mill having a plurality of roll stands arranged along a mill pass line, each roll stand having at least a first pair of work rolls mounted in cantilever fashion on a pair of first roll shafts, said first roll shafts having first pinion gears which are separate from each other and in meshed relationship respectively with one of a pair of intermeshed spur gears carried on a pair of intermediate drive shafts, said first roll shafts and said intermediate drive shafts extending in parallel relationship, with one of the intermediate drive shafts of each roll stand being coupled to one of two line shafts extending in parallel relationship to the mill pass line, the improvement comprising:

at least one of said roll stands being provided with a second pair of work rolls mounted in cantilever fashion on a pair of second roll shafts, said second roll shafts extending in parallel relationship to said intermediate drive shafts and having second pinion gears which are separate from each other and in meshed relationship respectively with one of the intermeshed spur gears of the said one roll stand.

2. The rolling mill of claim 1 wherein said first and second pinion gears have different numbers of teeth.

3. The rolling mill of claim 2 wherein said first and second pinion gears have different diameters.

* * * * *